US007216823B2

(12) United States Patent
Delille

(10) Patent No.: US 7,216,823 B2
(45) Date of Patent: May 15, 2007

(54) SYSTEM FOR FIXING THE MOBILE JAW OF A CONE OR GIRATORY CRUSHER

(75) Inventor: Jean Pierre Delille, Romaneche-Thorins (FR)

(73) Assignee: Metso Minerals S.A., Macon (FR)

( * ) Notice: Subject to any disclaimer, the term of this patent is extended or adjusted under 35 U.S.C. 154(b) by 155 days.

(21) Appl. No.: 10/538,040

(22) PCT Filed: Dec. 1, 2003

(86) PCT No.: PCT/FR03/03540

§ 371 (c)(1),
(2), (4) Date: Jun. 8, 2005

(87) PCT Pub. No.: WO2004/065012

PCT Pub. Date: Aug. 5, 2004

(65) Prior Publication Data

US 2006/0113414 A1 Jun. 1, 2006

(30) Foreign Application Priority Data

Dec. 20, 2002 (FR) ..... 02 16270

(51) Int. Cl.
*B02C 2/00* (2006.01)

(52) U.S. Cl. ..... 241/207

(58) Field of Classification Search ..... 241/207–216, 241/300

See application file for complete search history.

(56) References Cited

U.S. PATENT DOCUMENTS

| | | | |
|---|---|---|---|
| 3,908,915 | A | 9/1975 | Milenkovic |
| 4,666,092 | A | 5/1987 | Bremer |
| 6,129,297 | A | 10/2000 | Sawant et al. |

FOREIGN PATENT DOCUMENTS

| | | |
|---|---|---|
| FR | 2 459 077 | 1/1981 |

*Primary Examiner*—Mark Rosenbaum
(74) *Attorney, Agent, or Firm*—Young & Thompson

(57) ABSTRACT

A system for fixing the mobile jaw on a conical head of a cone or giratory stone crusher, includes a bowl, with a feed hopper mounted thereon, a fixed truncated jaw mounted coaxially with the bowl, a crushing head mounted on a main shaft coaxial with the fixed jaw and a conical mobile jaw mounted on the head and clamped thereon by a locking element integral with the head and pressing on the top of the mobile jaw. The element has on its outer periphery notches radially oriented outwards and uniformly distributed on the periphery and the mobile jaw has, on its inner periphery, at its openings studs radially oriented inwards, uniformly distributed on the periphery and matching in number the notches, the studs penetrating when mounted in the notches so as to secure the locking element and the mobile jaw in rotation when the crusher is operating.

2 Claims, 2 Drawing Sheets

SYSTEM FOR FIXING THE MOBILE JAW OF A CONE OR GIRATORY CRUSHER

The present invention relates to a system for securing the movable jaw of a cone or gyratory crusher. Cone crushers and gyratory crushers are adapted for mine or quarry installations and serve for the reduction of the size of the granulates and minerals to the dimensions required for their ultimate use.

They comprise a truncated conical crushing bowl, whose wall supports a fixed jaw, and a conical head bearing the movable jaw mounted on a shaft coaxial to the bowl. The geometrical axis of the conical head forms at the summit of this latter a certain angle with the axis of the principal shaft, which gives to the head, when the eccentric turns, a nutatory movement. During descent into the bowl, the materials are progressively crushed so as to reach the dimension of the smallest space r between the fixed jaw and the movable jaw, at the level of the base of the head in nutation and located at 2 in FIG. 1 showing a cone crusher.

Figure 1:
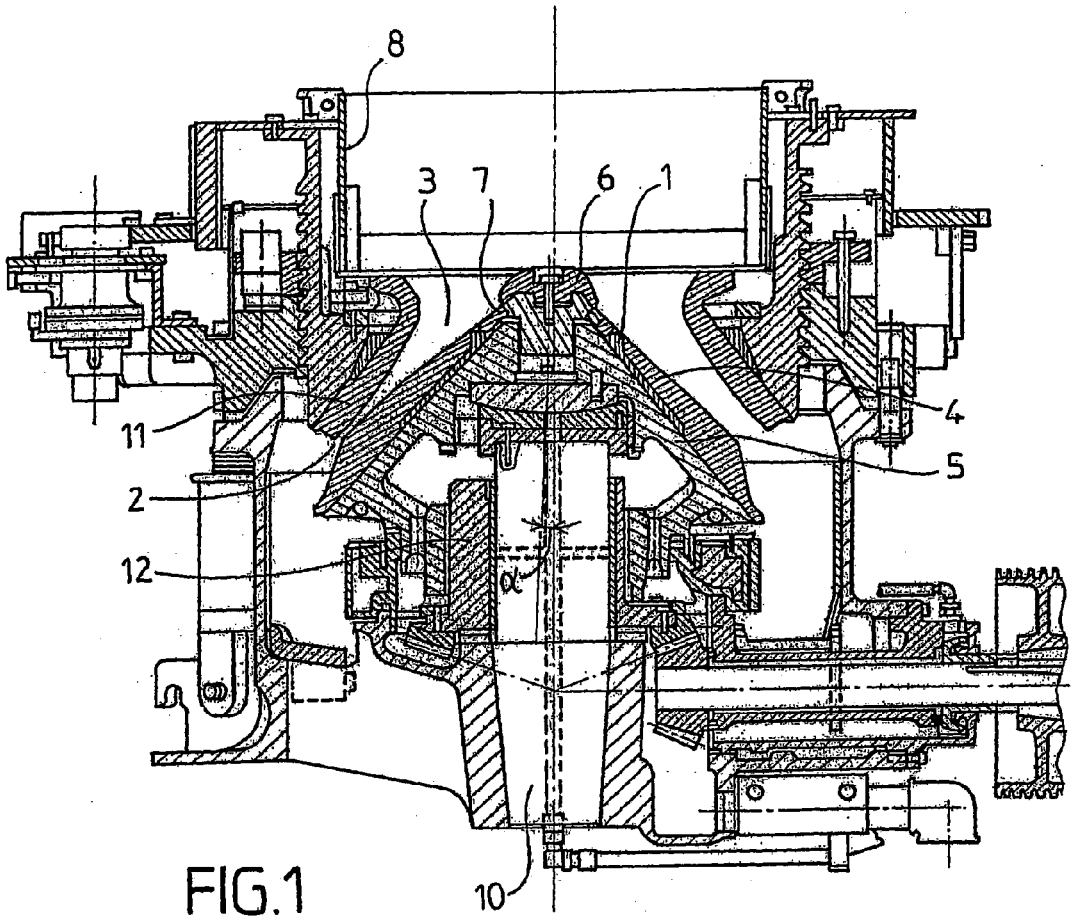

The cone crusher according to FIG. 1, comprises a supply hopper 8 located above the opening 1 of a crushing chamber or bowl 3. The crushing head 5 is supported by a shaft 10 above a bearing for this latter, with its geometric axis forming, thanks to an eccentric 12, an axis $\alpha$ with the axis of the shaft so as to have a nutatory movement when the eccentric 12 turns. The fixed jaw 11 is fixed below the opening 1, in the upper part of the bowl 3.

The movable jaw 4 is mounted on the head 5 and rests in its lower portion on the head 5, whilst it is gripped at its upper portion on the head by a screw 6, by means of a ring 7. This gripping is effected by a component of the gripping force of the screw 6 directed along the generatrix of the cone of the movable jaw 4.

In the course of the crushing operation, the pieces which wear down the most quickly are the jaws and particularly this movable jaw 4. Because of this, the latter must be periodically changed after wear. Thus, when the material to be crushed is constituted by pure silica, the lifetime of the jaw 4 cannot exceed several tens of hours. On the other hand, when it is a matter of limestone, this lifetime can extend to several years.

To this end, it is fixed immovably on the head by means of the screw 6. This gripping of the screw 6 requires a very high force so as to avoid the jaw knocking against the head. To grip it, there is generally used a key on which the operator taps with a sledgehammer. Moreover, in the course of operation, the movable jaw 4 has the tendency to turn on the head but, with this movement, it drives the screw 6 which self locks while holding the jaw. The self locking of the screw ensures that disassembly also requires the application of a very high force. So as to facilitate disassembly, a ring 7 is interposed between the screw head and the upper edge of the movable jaw. For disassembly, this ring is cut with a blowtorch and removed with a suitable tool, which frees the screw but which can then turn freely.

So as to facilitate assembly and disassembly of the jaw, according to French patent application No. 02 09256, the securement system comprises a blocking element, whose diameter is at least equal to that of the summit of the cone of the movable jaw, which is provided with holes spaced about its periphery, into which are threaded screws which screw into tappings located in the head or are pre-secured with this latter.

According to one embodiment of the cone crusher disclosed in that application, the blocking element is constituted by two parts, by a blocking plate provided with holes distributed about its periphery, and a blocking stud located therebelow, screwed into an axial tapping in the head and secured in rotation with said plate, the gripping taking place by means of screws passing through the holes of the plate and locking into the tappings provided in the blocking stud.

With further respect to that application, in the case of a gyratory crusher, the blocking element is constituted by a blocking ring provided with holes distributed about its periphery; a blocking nut, screwed on the shaft above the head and secured in rotation with said blocking ring, the gripping taking place by means of screws passing through the holes of the blocking ring and screwing into the tappings provided in said blocking nut.

The solution according to that mentioned application is quite suitable to facilitate assembly and disassembly of the movable head. However, strong gripping is still necessary to prevent the jaw from turning relative to the blocking plate or relative to the gripping nut (gyratory crusher). There must accordingly be found a solution to the problem of securing in rotation the plate (or the nut) and the jaw.

To solve this problem, the present invention provides in a system that said element has on its external periphery radially outwardly directed notches regularly spaced about said periphery, and that the movable jaw has, on its internal periphery, at the level of its opening, lugs directed radially inwardly, regularly spaced about said periphery and of a number equal to said notches, the lugs in the assembled condition being disposed in said notches so as to secure the blocking element and the movable jaw in rotation during operation of the crusher.

According to the invention, the number of lugs and notches is preferably equal to four. It can however be fewer or more, given that the number of notches is at least equal to the number of lugs.

Figure 4:
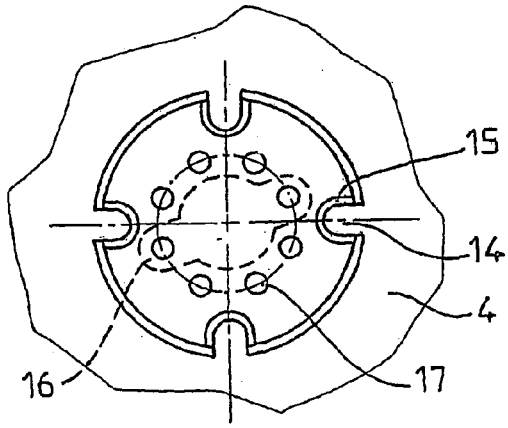
Figure 2:
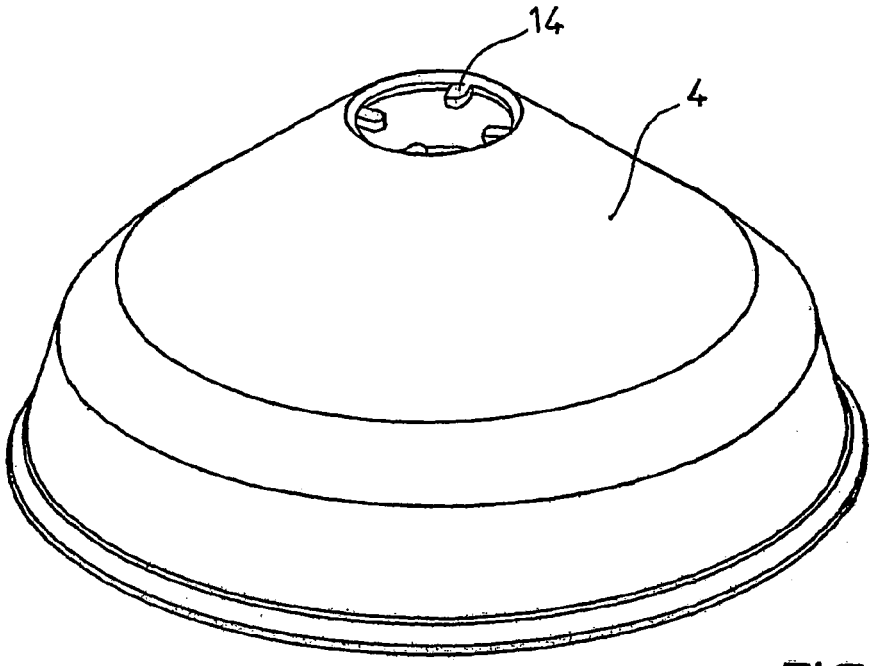
Figure 3:
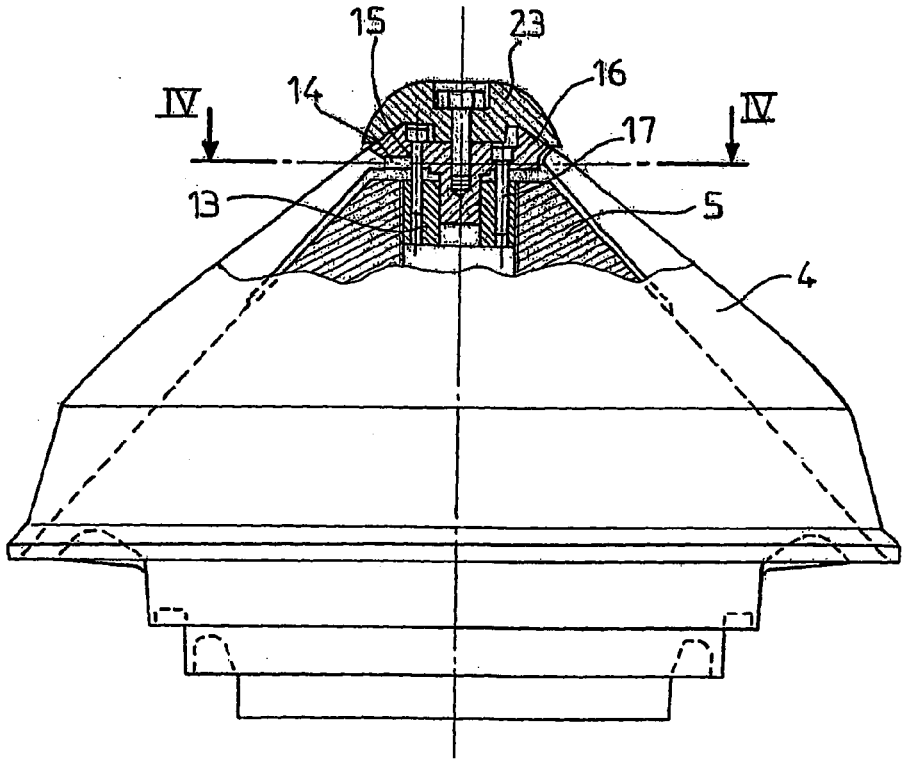

The invention will be better understood from a non-limiting embodiment described hereafter and shown in the accompanying drawings, in which are shown:

FIG. 1: A schematic cross-section of a cone crusher according to the prior art;

FIG. 2: A top perspective view of the movable jaw according to the present invention;

FIG. 3: A schematic cross-section of the securement of the movable jaw of a cone crusher according to the invention;

FIG. 4: A cross-sectional view on the line IV—IV of FIG. 3.

As shown in FIG. 3, the movable jaw 4 is disposed on the conical head 5 and conventionally rests, as shown in FIG. 1, on the lower wide portion of the conical head. Its gripping in this position takes place by means of a blocking element constituted by a screw in two parts, a blocking plate 16 whose diameter is at least equal to the external diameter, at its upper portion, of the cone formed by the jaw 4 and a screw-threaded lug 13 secured to the plate by screws 17.

A protective cap 23 for the heads of the screw 17 is also provided on the blocking plate and simply fixed on this latter with a screw.

As is indicated above for the prior art, the rotation of the jaw 4, during operation relative to the head 5, produces a self-gripping of the piece 16, 13 and thus permits holding a suitable gripping despite wear of the jaw.

However, in operation, when the jaw 4 slides on the head despite substantial gripping, it also slides relative to the blocking plate 16 in its rotation. This latter then only partially transmits the rotational couple to the lug 13 by the screws 17.

To ensure securement of the jaw 4 and the blocking plate 16, the lugs 14 are provided on the internal periphery of the jaw 4 at the level of its upper opening. Notches 15 are of corresponding shape and equal number are provided on the periphery of the blocking plate 16. Notches and lugs are regularly spaced about said peripheries so as to engage with each other.

In this way, during operation of the crusher, a rotation of the jaw 4 gives rise to a rotation of the blocking element 16 and a self-gripping of the couple constituted by the blocking plate 16 and the lug 13, hence a self-gripping of the jaw 4 on the head 5.

The same system of lugs and notches can be applied to the gyratory crusher, to secure the gripping lug and the jaw together.

FIG. 4 shows a cross-section of the system at the level of the opening of the cone forming the jaw 4. In the illustrated example, four lugs and four notches are provided. But there could be provided a lesser or a larger number of lugs and notches.

The invention claimed is:

1. System for securing the movable jaw on a conical head of a conical or gyratory stone crusher, comprising a bowl, surmounted by a hopper for supplying material to be crushed, a fixed truncated conical jaw mounted coaxially of the bowl, a crushing head mounted on a principal shaft coaxial to the fixed jaw, whose geometric axis makes an acute angle with that of the drive shaft so as to communicate to the head a nutatory movement when the eccentric turns, and a conical movable jaw having a circular opening at its summit, mounted on the head and gripped on the latter by means of a blocking element secured to the head and bearing on the summit of the movable jaw, characterized in that said element (16) has on its external periphery notches (15) directed radially outwardly and regularly spaced about said periphery, and that the movable jaw (4) has on its internal periphery at the level of its opening, lugs directed radially inwardly, regularly spaced about said periphery and in number equal to said notches (15), the lugs penetrating in the assembled condition into said notches so as to secure the blocking element (16) and the movable jaw (4) in rotation during operation of the crusher.

2. System for securement of the movable jaw according to claim 1, characterized in that the number of lugs and notches is equal to four.

* * * * *